US010035281B2

(12) United States Patent
Manura et al.

(10) Patent No.: US 10,035,281 B2
(45) Date of Patent: Jul. 31, 2018

(54) SAW SLICER GUIDE

(71) Applicant: Scientific Instrument Services, Inc., Ringoes, NJ (US)

(72) Inventors: John J. Manura, Ringoes, NJ (US); Thomas F. Coughlan, Sellersville, PA (US); Daniel Joseph Niedziocha, New Hope, PA (US); Christopher Wayne Baker, Doylestown, PA (US)

(73) Assignee: Scientific Instrument Services, Inc., Ringoes, NJ (US)

( * ) Notice: Subject to any disclaimer, the term of this patent is extended or adjusted under 35 U.S.C. 154(b) by 114 days.

(21) Appl. No.: 15/294,729

(22) Filed: Oct. 16, 2016

(65) Prior Publication Data

US 2018/0104752 A1 Apr. 19, 2018

(51) Int. Cl.

| | |
|---|---|
| ***B27B 25/10*** | (2006.01) |
| ***B27B 27/02*** | (2006.01) |
| ***B27B 27/10*** | (2006.01) |

(52) U.S. Cl.

CPC ..... *B27B 25/10* (2013.01); *B27B 27/02* (2013.01); *B27B 27/10* (2013.01)

(58) Field of Classification Search

CPC ..... B27B 25/10; B27B 27/00; B27B 27/02; B27B 27/04; B27B 27/08; B27B 27/10;

(Continued)

(56) References Cited

U.S. PATENT DOCUMENTS 292,309 A * 1/1884 Henderson ..... B27B 5/222 147/30
2,119,353 A * 5/1938 Reimer ..... B23D 49/007 83/410

(Continued)

FOREIGN PATENT DOCUMENTS

CA 2425026 A1 * 11/2003 ..... B27B 25/10
CA 2407368 A1 * 4/2004 ..... B23Q 3/007
GB 1 165 768 A 10/1969

OTHER PUBLICATIONS

"AccuRight® Log Mill™ | Magfence® II Band Saw Fence & Log Mill™ | Band Saw Products | Carter Products" available on http://www.carterproducts.com/band-saw-products/band-saw-magfence/accurightr-log-milltm, dated 3 pages.
"Buy Little Ripper and Round Ripper Online—Stockroom Supply" available on http://stockroomsupply.ca/shop/little-ripper-and-round-ripper.html, 3 pages.
"Sawmill Package With Round Ripper—Little Ripper and Round Ripper" available on http://stockroomsupply.ca/shop/little-ripper-and-round-ripper/sawmill-package-for-cutting-up-to-54.html, 2 pages.
"Make Drift a Myth" available on http://www.popularwoodworking.com/techniques/makedriftamyth, dated Feb. 15, 2011, 7 pages.

(Continued)

*Primary Examiner* — Jennifer Swinney
(74) *Attorney, Agent, or Firm* — Inspired Idea Solutions Law Firm; Wayne Carroll

(57) ABSTRACT

A device and method are disclosed. The device may be mountable in a band saw table with a miter slot parallel to the cutting plane. An anchor bar may be mountable in the miter slot. A first and second guide bar may be perpendicularly connected to the anchor bar extending away from the cutting plane. A base may be slideably engaged to the first and second guide bar to allow the base to have transverse movement relative to the cutting plane. A guide rail may be connected to the base, wherein the guide rail may be perpendicular to the first and second guide bar, and may be positioned parallel to the anchor bar. A carriage may be slideably engaged to the guide rail for movement along the guide rail in a direction parallel to the cutting plane, the carriage may have a mounting surface for mounting a workpiece.

18 Claims, 3 Drawing Sheets

(58) Field of Classification Search
CPC ..... Y10T 83/6608; Y10T 83/6612; Y10T 83/6614; Y10T 83/7593; Y10T 83/76; Y10T 83/7613; Y10T 83/6609; Y10T 83/6611; Y10T 83/662; Y10T 83/6622; Y10T 83/663; Y10T 83/6632
See application file for complete search history.

(56) References Cited

U.S. PATENT DOCUMENTS

| | | | | |
|---|---|---|---|---|
| 2,747,633 | A | 5/1956 | Burlin | |
| 2,895,513 | A * | 7/1959 | Cowley ..... | B23D 33/08 144/204.2 |
| 4,793,604 | A | 12/1988 | Taylor | |
| 5,195,730 | A | 3/1993 | Taylor | |
| 5,205,198 | A | 4/1993 | Foray et al. | |
| 5,215,296 | A | 6/1993 | Adams et al. | |
| 5,617,909 | A | 4/1997 | Duginske | |
| 5,716,045 | A | 2/1998 | Taylor | |
| 7,077,043 | B1 | 7/2006 | Koerble et al. | |
| 7,140,286 | B2 | 11/2006 | Schwartz | |
| 7,377,200 | B2 | 5/2008 | Moore | |
| 7,621,206 | B2 | 11/2009 | Makropoulos | |
| 7,930,960 | B2 | 4/2011 | Duginske | |
| 7,997,313 | B2 | 8/2011 | Wang | |
| 8,156,973 | B2 | 4/2012 | Stepp | |
| 8,789,450 | B2 | 7/2014 | Scherl | |
| 2013/0205967 | A1 | 8/2013 | Tardif | |

OTHER PUBLICATIONS

"Original INCRA Jig" available on http://www.incra.com/router_table_fences-ij32.html, 3 pages.

* cited by examiner

SAW SLICER GUIDE

FIELD

This disclosure relates to guides for band saws having a table, the guide having a rectilinearly moving work carriage and means to move the carriage (and workpiece) transversely towards the cutting plane of the saw.

BACKGROUND

Typically, the wood worker uses the band saw fence to guide the wood and cut it to the desired thickness. The woodworker must push the wood blank tightly against the band saw fence to keep it straight while at the same time pushing the wood at 90 degrees through the band saw blade. This method has two major drawbacks. The first problem is safety. In pushing the wood against the fence and through the band saw blade, the operator's fingers are very close to the band saw blade. The slightest slip of the hands or the wood and a serious accident is bound to happen.

The second problem is accuracy and smoothness of the cut. As the operator pushes the wood through the band saw blade, his hand pressure of the wood against the fence varies. Also the band saw blade can wander. As a result, the band saw cut is not smooth and can be quite wavy and may even result in burn marks on the cut wood surface.

Therefore, there is a need in the art for a guide that can overcome these disadvantages of prior systems and methods, and provide a safer smoother cut when cutting thin sections of wood from a workpiece.

Before explaining at least one embodiment in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the disclosed embodiments. It is important, therefore, that the claims be regarded as including such equivalent constructions insofar as they do not depart from the spirit and scope of the disclosed embodiments.

DETAILED DESCRIPTION

A band saw slicer was developed to make it easier and safer to cut thin sections of wood, known as re-sawing, and also to enable small pieces of wood or small round pieces of wood such as those used in segmented wood turning to be cut into thin sections. With some projects small pieces of wood may need to be cut into thin strips, or wood that is round or has other shapes that are difficult to hold and cut on a band saw or other saw. Some projects may require the ability to cut with accuracy and reproducible results, which is difficult or not possible on many prior systems.

Some embodiments of the band saw slicer may be useful in producing thin veneer strips, producing laminated strips, crafting wood pen blanks, and making segmented ring blanks for bowls and other wood turning projects. In some embodiments, wood strips may be produced as thin as 0.010 inches thick up to 2.0 inches thick. The accuracy of some embodiments may be up to 0.002 inches of thickness in a manner that is repeatable. The cuts may be produced as smooth clean cuts without burn marks or wavy cuts due to uneven pressure. Some or all of these advantages as well as others may be achieved by some embodiments of a band saw slicer as disclosed.

Figure 1:
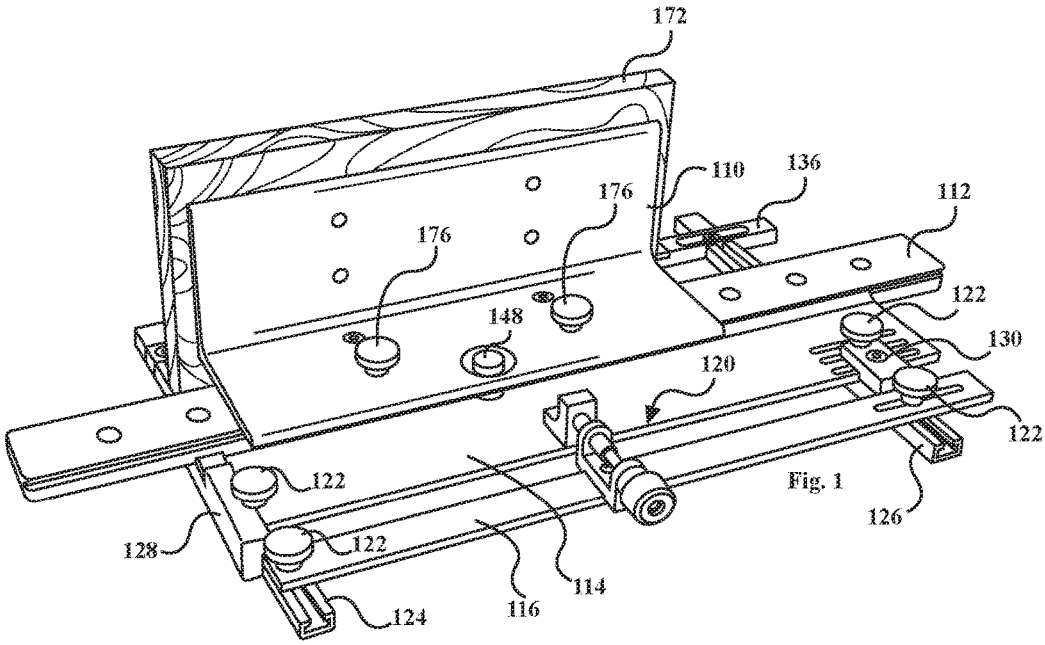
FIG. 1 shows an example of a band saw slicer with a carriage, rail and indexing system.
Figure 2:
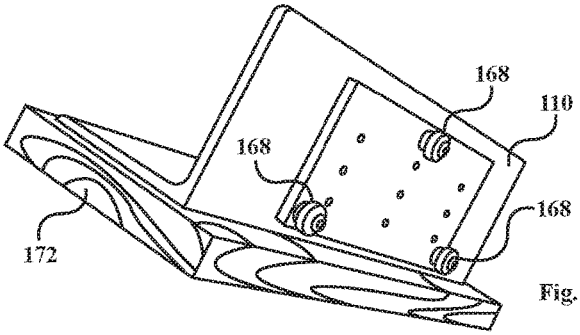
FIG. 2 shows an example ninety-degree L-bracket carriage for use with a band saw slicer.
Figure 3:
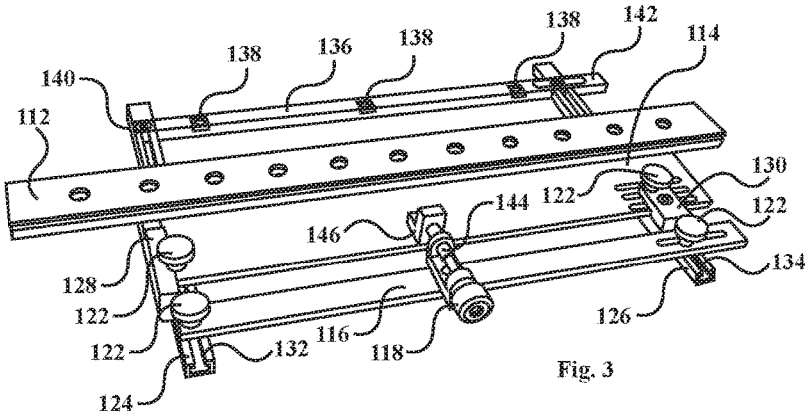
FIG. 3 shows an example of a band saw slicer without a carriage, comprising a rail, guide bars and index system.

FIGS. 1-3 show an embodiment of a band saw slicer device 100 that may include a carriage 110, a guide rail 112, a base 114, an indexing support 116, and an indexing device 120 that may include an indexing screw 118, an adjustable extension 144, and a receiving structure 146. The device 100 may also include an anchor bar 136 with an anchor bar first end 140 and an anchor bar second end 142, anchor mechanisms 138, a first guide bar 124, a second guide bar 126, a first linear guide 128 and a second linear guide 130. In some embodiments the device 100 includes a first guide slot 132 and a second guide slot 134. The device 100 may include releasable fasteners 122 to hold and release the position of the base 114 or indexing support 116 relative to the first guide bar 124 and second guide bar 126.

The carriage 110 may include roller bearings 168 that allow for a smooth interaction with the guide rail 112. The carriage 110 may include one or more push handles 176 to be used by a user in pushing the carriage 110 along the guide rail 112. A bearing adjuster 148 may allow adjustment of one or more of the roller bearings 168 to provide a smooth and accurate path for the carriage 110 along the guide rail 112. The carriage may include a sacrificial fence 172 attached to a portion of the carriage 110.

Referring to FIGS. 1-6, a device 100 may be mountable in a saw table 164 with a cutting plane 160 defined by a line along the saw table and defined by the cutting edge of the blade 162. The saw table 164 may have a table length along the cutting plane 160 and a miter slot 166 that is parallel to the cutting plane 160.

Figure 4:
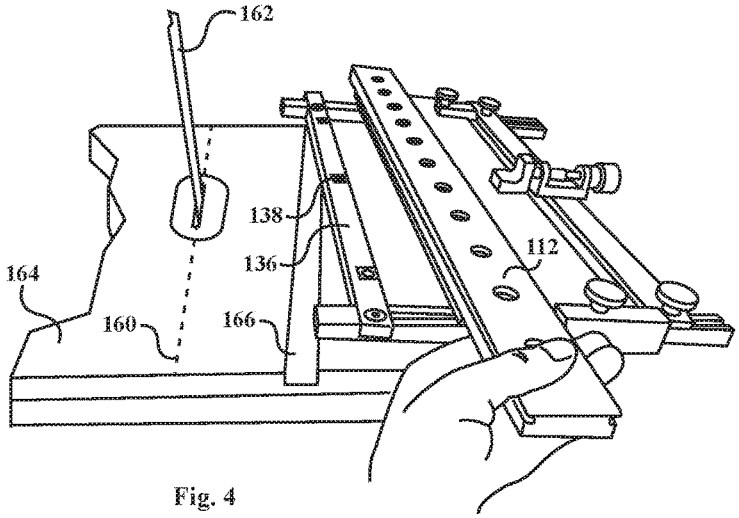
FIG. 4 shows an example band saw table with a miter slot, and an example band saw slicer.
Figure 5:
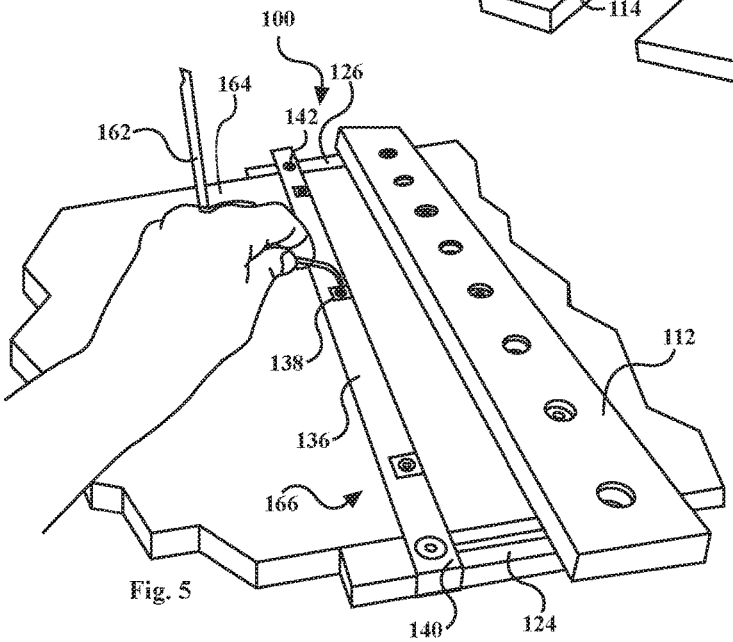
FIG. 5 shows an example band saw slicer mounted in the miter slot of a band saw table and locked into the miter slot.

As seen in FIGS. 4 and 5, a user may move the device 100 so that the anchor bar 136 is in position in the miter slot 166 of a saw table 164. The anchor bar 136 may be mountable in the miter slot 166 with at least one anchor mechanism 138 to removably secure the anchor bar in the miter slot 166. The anchor mechanism 138 may be a brass locking nut that moves laterally when turned so that by turning a bolt or screw, the anchor mechanism 138 pushes against the sides of the miter slot 166 thereby removably mounting the anchor bar 136 in the miter slot 166. Other anchor mechanisms may be used including magnetic, expanding, fasteners, or other anchor mechanisms capable of securing the anchor bar to the miter slot 166.

In some embodiments the anchor bar 136 has an anchor bar first end 140 and an anchor bar second end 142. The anchor bar 136 may have a top that sits relatively flush at or below the saw table surface, with the saw table 164 when installed. The anchor bar first end 140 and anchor bar second end 142 may extend beyond the length of the saw table 164 and both ends 140, 142 may be connected to guide bars. In some embodiments the first guide bar 124 may be perpendicularly connected to the anchor bar first end 140 and may extend away from the cutting plane 160. The second guide bar 126 may be perpendicularly connected to the anchor bar second end 142 and may extend away from the cutting plane 160.

The anchor bar 136 may have an adjustable connection with the second guide bar to adjust the distance between the first guide bar 124 and the second guide bar 126. In some embodiments the distance between the first guide bar 124 and the second guide bar 126 may be adjusted so that when the device 100 is installed on a saw table 164 the first guide bar 124 and the second guide bar 126 are parallel to and in close proximity to edges of the saw table 164. In other embodiments the first guide bar 124 and the second guide bar 126 may be configured so that they are not in close proximity to edges of the saw table 164. In some embodiments there may be a distance between the first guide bar 124 and the second guide bar 126 between about twelve inches to about thirty-six inches. Some embodiments may have an adjustment of the distance between the first and second guide bars 124, 126, for example, a device 100 may be adjustable between about fifteen inches and twenty-four inches, and may fit on saw tables with a length between about fifteen inches to about twenty-four inches.

In some embodiments a base 114 may be slideably engaged to the first guide bar 124 and the second guide bar 126 and may allow the base 114 to have transverse movement relative to the cutting plane 160. The base 114 may have a length that is greater than the distance between the first guide bar 124 and the second guide bar 126. The base may be a solid material, such as a plate of metal, that is capable of rigidly holding a shape and supporting the guide rail 112 and carriage 110.

In some embodiments a guide rail 112 may be connected to the base 114. The guide rail 112 may be perpendicular to the first guide bar 124 and the second guide bar 126, and may be positioned parallel to the anchor bar 136. The length of the guide rail 112 may determine the length of wood piece or workpiece that can be cut using the device 100. In some embodiments guide rails may be from twelve inches to sixty inches long. Larger lengths can also be made. Some embodiments may have guide rail 112 lengths of twenty-four inches, thirty-six inches, forty-eight inches and seventy-two inches. The illustrations show a guide rail 112 as a single rail with bearings riding on side grooves on the rail. In some embodiments the guide rail 112 includes multiple rails, and may include a system where the carriage 110 rides in one or more channels, grooves, or structures to move the carriage 110 substantially rectilinearly and parallel to the cutting plane 160.

Referring now to FIGS. 1-8, in some embodiments a carriage may be slideably engaged to the guide rail 112 for movement along the guide rail 112 in a direction parallel to the cutting plane 160. The carriage may have a mounting surface 170 for mounting a workpiece 174. The carriage 110 may include a sacrificial fence 172 attached to an L-bracket. The mounting surface 170 may be a surface of the sacrificial fence 172 that is closest to and facing the cutting plane 160. The sacrificial fence 172 may move with the carriage 110 and support the workpiece 174 as it moves through a cutting zone and is sliced into thin pieces. In some embodiments a sacrificial fence may be omitted and the workpiece 174 may be attached to the carriage using screws that pass through an L-bracket to screw the workpiece directly to the L-bracket portion of the carriage 110 using short wood screws.

In some embodiments only the workpiece extends from the mounting surface 170 towards the cutting plane 160, with no support for the workpiece 174 extending beyond the mounting surface 170 towards the cutting plane 160. The carriage 110 may be made with no support under or over the workpiece 174. The workpiece 174 may be attached to the mounting surface 170 in one or more ways. In some embodiments adhesive strips are used between the mounting surface 170 and the workpiece 174. A workpiece may be supported on the mounting surface 170 with double sided tape or hot-melt glue or other adhesives separately or in combination with other attachment methods. There may be a benefit of using a carriage 110 with no support below the workpiece, in that multiple slices may be made from one workpiece 174 even until there is only a very small amount of the workpiece left mounted on the mounting surface, all without the need to remove and re-mount the workpiece.

In some embodiments the first guide bar 124 may have a first guide slot 132. The second guide bar 126 may have a second guide slot 134. The base may include releasable fasteners 122 connected to the first guide slot 132 and the second guide slot 134. The releaseable fasteners 122, when loose, may allow the base 114 and the indexing support 116 to move along the first guide bar 124 and the second guide bar 126 with a movement towards or away from the cutting plane 160.

Figure 7:
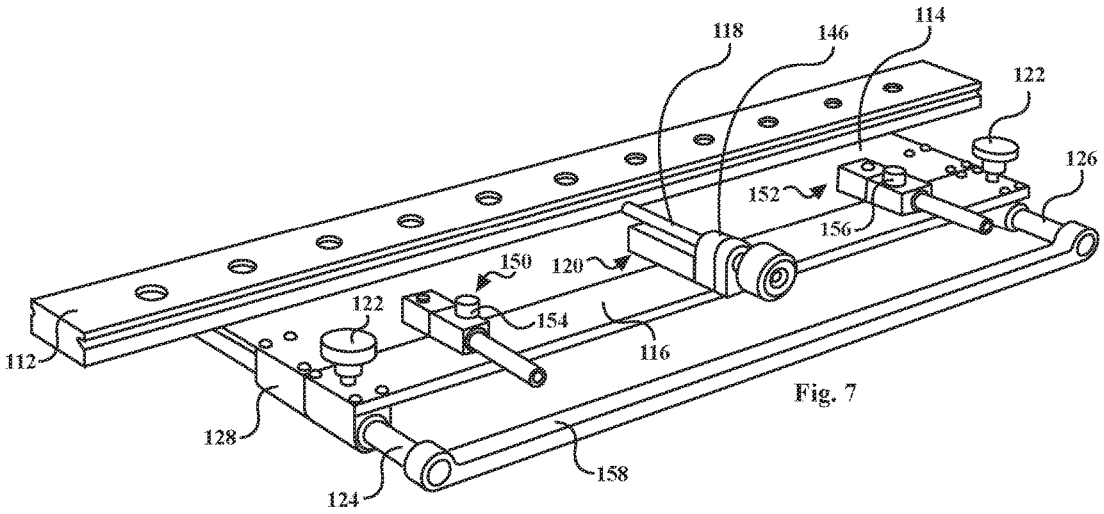
FIG. 7 shows an example band saw slicer without a carriage including indexing guides.

The base 114 may include one or more linear guides 128 that extend along the first guide bar 124 and prevent substantial linear deviation of the base 114 as it moves along the first guide bar 124. The example embodiment shown in FIG. 3 includes guide bars 124, 126 with guide slots 132, 134 or channels to direct the travel of the base 114 and indexing support 116. In the embodiment of FIG. 7 the guide bars 124, 126 may be bars that pass through a tight fitting opening in the linear guides 128, 130 that are connected to the base 114 and the indexing support 116. In some embodiments the indexing support 116 may be positioned on the guide bars 124, 126 further from the anchor bar 136 than the base 114.

In some embodiments the indexing support 116 may be slideably engaged to the first guide bar 124 and the second guide bar 126 to allow the indexing support to have transverse movement relative to the cutting plane 160. The device 100 may provide incremental advancement of the workpiece 174 towards the cutting plane 160 by tightening the releasable fasteners 122 connected to the indexing support 116, and adjusting a distance between the indexing support 116 and the base 114, thereby adjusting the distance between the base 114 and the cutting plane 160. The guide rail 112 and carriage 110 may move with the base 114, and therefore adjusting the distance between the indexing support 116 and the base 114 while the indexing support 116 is secured relative to the guide bars 124, 126 may adjust the distance of the carriage 110 and a workpiece 174 supported by the carriage 110.

An indexing device 120 may be connected to the indexing support 116 and may extend towards the base 114, wherein the indexing device 120 may adjust a distance between the indexing support 116 and the base 114.

In some embodiments the indexing device 120 may include an indexing screw 118 which may be secured to the indexing support 116. The indexing device 120 may include a receiving structure 146 connected to the base 114, wherein the receiving structure 146 may be aligned to receive an adjustable extension 144 supported by the indexing support 116. Adjusting the indexing screw 118 adjusts the distance between the indexing support 116 and base 114.

Figure 6:
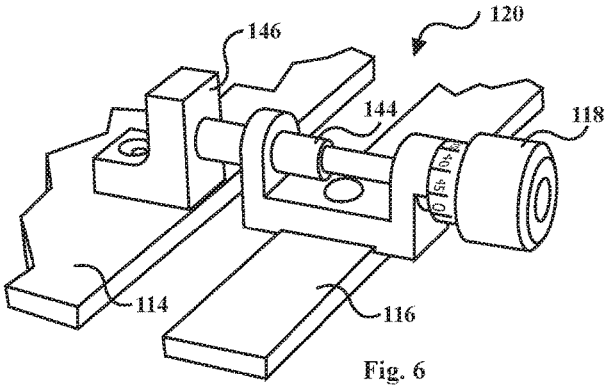
FIG. 6 shows an example indexing device for making incremental movements transversely towards the cutting plane.

In the example embodiment shown in FIG. 6, an embodiment of an indexing device 120 is shown. The indexing screw 118 may be adjusted to bring the board to be cut to a desired position. A first cut may be used to square the end or edge of the workpiece 174. The device 100 may be adjusted to cut off approximately 0.020" of wood plus the kerf of the blade. The indexing screw 118 may including markings to indicate when one full rotation or a portion of a rotation has been made, and therefore allow for accurate, repeatable operation. The adjustable extension 144 may be extended towards or away from the receiving structure 146, that is connected to the base 114, using the indexing screw 118.

In the embodiment shown in FIG. 7 the adjustable extension may include an indexing screw 118 where the receiving structure 146 includes a threaded opening configured to receive the indexing screw 118. In some embodiments a first indexing guide 150 may be connected between the base 114 and the indexing support 116. The first indexing guide 150 may include a first indexing lock 154 to secure the distance between the indexing support 116 and the base 114. A second indexing guide 152 may also be connected between the base 114 and the indexing support 116 and may have a second indexing lock 156 to secure the distance between the indexing support 116 and the base 114.

In some embodiments ends of the first guide bar 124 and the second guide bar 126 may be connected to a frame support 158. The frame support 158 may secure the distance between the first guide bar 124 and the second guide bar 126 at a second end, while the anchor bar 136 may secure the distance at the first end.

Figure 8:
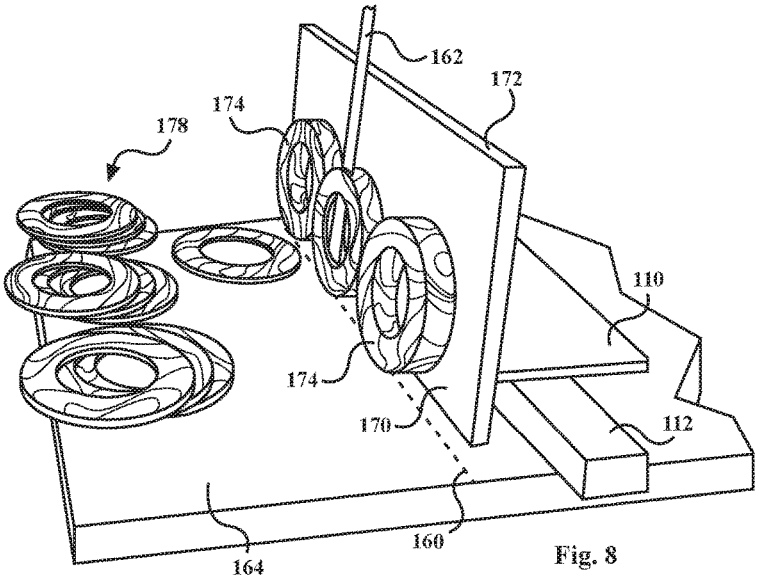
FIG. 8 shows an example carriage with a sacrificial fence, and workpieces attached to the sacrificial fence in the process of being cut into thin slices with a band saw.

FIG. 8 shows an example operation of a band saw with a blade 162 in the process of cutting a workpiece 174. Multiple cut pieces 178 are shown. Details of the device 100 are not shown in this drawing which may be present in various embodiments.

A user may operate the device 100 by attaching the anchor bar 136 to the miter slot 166 of a saw table 164. The user may attach a workpiece 174 to the mounting surface 170 (which may be a sacrificial fence 172 or a portion of the carriage 110). The user may release the releasable fasteners 122 to adjust the position of the base 114 and indexing support 116, and thereby adjusting the position of the workpiece 174 that is mounted on the carriage 110 relative to the cutting plane 160, moving a portion of the workpiece 174 into the cutting plane. The user may secure the adjustable fasteners so that the base 114 and the indexing support 116 are secure relative to the guide bars 124, 126. The user may operate the saw, and hold the carriage 110 by the push handles 176 (keeping hands safely away from the blade 162) to advance the carriage, and therefore the workpiece, through the cutting zone of the blade 162. The user may reverse the movement of the carriage 110 to bring the workpiece 174 into a position where it can enter the cutting zone. The user may release the releasable fasteners 122 or the first and second indexing locks 154, 156, and then turn the indexing screw 118 to advance the workpiece into the cutting plane 160, with the number of rotations or partial rotations setting the resulting thickness of a cut piece 178. The user may tighten the releasable fasteners 122 or the first and second indexing locks 154, 156 and advance the carriage again using the push handles 176 to cut another slice of the workpiece 174.

The device may be automated, for example stepper motors may be connected to the carriage and rail to automate the process of cutting multiple slices from a workpiece.

In some embodiments a carriage with a different shape or size may be used to enable cutting options such as the cutting of Celtic rings and jewelry and other applications.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A device mountable in a saw table with a cutting plane, the saw table having a table length along the cutting plane and a miter slot that is parallel to the cutting plane, the device comprising:

an anchor bar mountable in the miter slot with at least one anchor mechanism to removably secure the anchor bar in the miter slot, the anchor bar having an anchor bar first end and an anchor bar second end;

a first guide bar perpendicularly connected to the anchor bar first end and extending away from the cutting plane;

a second guide bar perpendicularly connected to the anchor bar second end and extending away from the cutting plane;

a base slideably engaged to the first guide bar and the second guide bar to allow the base to have transverse movement relative to the cutting plane;

a guide rail connected to the base, wherein the guide rail is perpendicular to the first guide bar and the second guide bar, and positioned parallel to the anchor bar; and a carriage slideably engaged to the guide rail for movement along the guide rail in a direction parallel to the cutting plane, the carriage having a mounting surface for mounting a workpiece.

2. The device of claim 1, the first guide bar having a first guide slot, the second guide bar having a second guide slot, wherein the base includes releasable fasteners connected to the first guide slot and the second guide slot.

3. The device of claim 1 further comprising an indexing support slideably engaged to the first guide bar and the second guide bar to allow the indexing support to have transverse movement relative to the cutting plane, and an indexing device connected to the indexing support and extending towards the base, wherein the indexing device adjusts a distance between the indexing support and the base.

4. The device of claim 3 wherein the indexing device includes an indexing screw.

5. The device of claim 3 wherein the indexing device includes a receiving structure connected to the base, wherein the receiving structure is aligned to receive an adjustable extension supported by the indexing support.

6. The device of claim 5 wherein the adjustable extension is extended towards or away from the receiving structure with an indexing screw.

7. The device of claim 5 wherein the adjustable extension includes an indexing screw, and wherein the receiving structure includes a threaded opening configured to receive the indexing screw.

8. The device of claim 1 wherein the base includes a linear guide that extends along the first guide bar and prevents substantial linear deviation of the base as it moves along the first guide bar.

9. The device of claim 3 further comprising a first indexing guide connected between the base and the indexing support, wherein the first indexing guide includes a first indexing lock to secure the distance between the indexing support and the base.

10. The device of claim 1 wherein there is a distance between the first guide bar and the second guide bar within a range of about 12 inches to about 36 inches.

11. The device of claim 1 wherein the carriage has no support for the workpiece extending beyond the mounting surface towards the cutting plane so that only the workpiece extends from the mounting surface towards the cutting plane.

12. A device mountable in a saw table with a cutting plane, the saw table having a table length along the cutting plane and a miter slot that is parallel to the cutting plane, the device comprising:

an anchor bar mountable in the miter slot with at least one anchor mechanism to removably secure the anchor bar in the miter slot, the anchor bar having an anchor bar first end and an anchor bar second end;

a first guide bar perpendicularly connected to the anchor bar first end and extending away from the cutting plane;

a second guide bar perpendicularly connected to the anchor bar second end and extending away from the cutting plane, wherein there is a distance between the first guide bar and the second guide bar within a range of about 12 inches to about 36 inches;

a base slideably engaged to the first guide bar and the second guide bar to allow the base to have transverse movement relative to the cutting plane;

a guide rail connected to the base, wherein the guide rail is perpendicular to the first guide bar and the second guide bar, and positioned parallel to the anchor bar;

a carriage slideably engaged to the guide rail for movement along the guide rail in a direction parallel to the cutting plane, the carriage having a mounting surface for mounting a workpiece;

an indexing support slideably engaged to the first guide bar and the second guide bar to allow the indexing support to have transverse movement relative to the cutting plane, and an indexing device connected to the indexing support and extending towards the base, wherein the indexing device adjusts an index distance between the indexing support and the base;

wherein the indexing device includes a receiving structure connected to the base, wherein the receiving structure is aligned to receive an adjustable extension supported by the indexing support;

wherein the adjustable extension includes an indexing screw, and wherein the receiving structure includes a threaded opening configured to receive the indexing screw;

wherein the carriage has no support for the workpiece extending beyond the mounting surface towards the cutting plane so that only the workpiece extends from the mounting surface towards the cutting plane; and a first indexing guide connected between the base and the indexing support, wherein the first indexing guide includes a first indexing lock to secure the distance between the indexing support and the base.

13. A method of making a guide system for a saw table, having a table length along a cutting plane and miter slot with a slot width comprising:

forming an anchor bar that includes an anchor length which is equal to or longer than the table length and shorter than or equal to 36 inches, and an anchor width that is equal to or less than the slot width;

affixing a first guide bar perpendicularly connected in relation to the anchor bar;

affixing a second guide bar perpendicularly connected in relation to the anchor bar, and extending parallel to the first guide bar;

securing a base slideably engaged to the first guide bar and the second guide bar to allow the base to have transverse movement relative to the cutting plane;

connecting a guide rail to the base, wherein the guide rail is perpendicular to the first guide bar and the second guide bar, and positioned parallel to the anchor bar; and engaging a carriage to the guide rail to slide along the guide rail for movement in a direction parallel to the cutting plane, the carriage having a mounting surface for mounting a workpiece.

14. The method of making the guide system for the saw table according to claim 13 further comprising:

securing an indexing support slideably engaged to the first guide bar and the second guide bar to allow the indexing support to have transverse movement relative to the cutting plane; and connecting an indexing device to the indexing support extending towards the base, wherein the indexing device adjusts a distance between the indexing support and the base.

15. The method of making the guide system for the saw table according to claim 14 further comprising:

affixing the indexing device to the base.

16. The method of making the guide system for the saw table according to claim 14 further comprising:

affixing a first indexing guide connected between the base and the indexing support.

17. The method of making the guide system for the saw table according to claim 6 further comprising:

affixing a first indexing lock to the first indexing guide, wherein the first indexing lock secures the distance between the indexing support and the base.

18. The method of making the guide system for the saw table according to claim 13 further comprising:

forming the carriage with no support for the workpiece extending beyond the mounting surface towards the cutting plane so that only the workpiece extends from the mounting surface towards the cutting plane.

* * * * *